US006457397B1

(12) United States Patent
Guesnet et al.

(10) Patent No.: US 6,457,397 B1
(45) Date of Patent: Oct. 1, 2002

(54) LOADING DEVICE FOR A SHELL IN THE CANNON CHAMBER OF A WEAPON FITTED WITH A SCREW BREECH

(75) Inventors: Dominique Guesnet, Saint Germain du Puy; Didier Thebault, Bourges; Gilles Lamure, Bourges; Franck Pollet, Bourges, all of (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 09/604,691

(22) Filed: Jun. 28, 2000

(30) Foreign Application Priority Data

Jul. 22, 1999 (FR) ..... 99 09498

(51) Int. Cl.[7] ..... F41A 9/42
(52) U.S. Cl. ..... 89/46; 89/47
(58) Field of Search ..... 89/45, 46, 47, 89/33.05

(56) References Cited

U.S. PATENT DOCUMENTS

| | | | | |
|---|---|---|---|---|
| 1,682,323 A | * | 8/1928 | Conlon | 89/47 |
| 3,598,016 A | * | 8/1971 | Chiabrandy et al. | 89/47 |
| 5,563,363 A | * | 10/1996 | Soulaigre et al. | 89/46 |

FOREIGN PATENT DOCUMENTS

| | | | |
|---|---|---|---|
| EP | 352584 | * | 1/1990 |
| FR | 348731 | | 4/1905 |
| FR | 400386 | | 7/1909 |
| FR | 2 448 121 | | 8/1980 |
| FR | 2 721 387 | | 12/1995 |

* cited by examiner

*Primary Examiner*—Stephen M. Johnson
(74) *Attorney, Agent, or Firm*—Parkhurst & Wendel, LLP

(57) ABSTRACT

The invention relates to a loading device for a shell in the cannon chamber of a weapon fitted with a screw breech incorporating a receiving tray onto which the shell is positioned, enabling it to be brought from a set up position to a loading position in which the shell is aligned with the cannon axis, ramming means and means to wedge the shell in the cannon operating successively, the ramming means and the wedging means being integral with the tray, said tray being connected to the slide of the weapon in an articulated manner in order to move the shell from the set up position to the loading position, the wedging means being connected in an articulated manner with respect to the tray such that after the shell has been rammed into place said wedging means partially engage in the tray substantially in the cannon axis, said tray being engaged in the weapon breech in abutment against a sealing cone of the cannon. The tray is fitted at its front end with protection means abutting against said sealing cone.

14 Claims, 11 Drawing Sheets

LOADING DEVICE FOR A SHELL IN THE CANNON CHAMBER OF A WEAPON FITTED WITH A SCREW BREECH

BACKGROUND OF THE INVENTION

The technical scope of the present invention is that of loading devices for weapons and in particular for large caliber weapons.

So-called field artillery must be loaded by means of a tray onto which the shell or the round is placed. Then, the shell is introduced into the weapon using a ramming device and a wedging device and this automatically.

Thus, Patents FR-A-2448121 and FR-2721387 propose positioning mechanisms in which a receiving tray for the shell is brought by rotation into the cannon axis, then the shell is translated by means of the rammer until it reaches a loading position and lastly, after a second rotation of the tray, wedging means are brought into the cannon axis to move the shell until it reaches a wedged position in the forcing cone of the cannon. This type of device is fully adapted for a weapon having a breech block whose ring serves to extend the tray for the positioning of the shell, but can not be implemented in a weapon having a screw breech. Indeed, in this latter type of weapon, the tray carrying the shell must penetrate into the breech so as to accompany the shell until it reaches the opening of the barrel during the positioning operations and it is thus impossible to ensure the second rotation of said tray to bring the rammer into the cannon axis and so wedge the shell in position.

SUMMARY OF THE INVENTION

The aim of the present invention is to supply a loading device for a piece of artillery fitted with a screw breech able to reliably and rapidly ensure the positioning of the shell whilst avoiding any deterioration to the sealing means and ensuring firing reliability.

The subject of the invention is thus a loading device for a shell in the cannon chamber of a weapon fitted with a screw breech incorporating a receiving tray onto which the shell is positioned, enabling it to be brought from a set up position to a loading position in which said shell is aligned with the cannon axis, ramming means and means to wedge said shell in said cannon operating successively, said ramming means and said wedging means being integral with the tray, said tray being connected to the slide of said weapon in an articulated manner in order to move said shell from the set up position to the loading position, said wedging means being connected in an articulated manner with respect to said tray such that after said shell has been rammed into place said wedging means partially engage in said tray substantially in said cannon axis, said tray being engaged in the weapon breech in abutment against a sealing cone of said cannon, wherein said tray is fitted at its front end with protection means abutting against said sealing cone.

The protection means are advantageously assembled in a flexible manner with respect to the tray in order to eliminate any possible differences in the gaps between the breech and the tray and they are integral with rods mounted sliding with respect to the tray, springs being positioned between the tray and the protection means.

The springs are placed around said rods.

According one embodiment the protection means are advantageously constituted by a ring of plastic material whose inner diameter is substantially greater than the outer diameter of the shell and whose outer profile is shaped to match that of the sealing cone.

According to another embodiment, the wedging means are connected to the tray by means of two wings articulated with respect to the tray, at least one jack being placed between the tray and the slide to bring aid means into a wedging position.

The wedging means are advantageously constituted by a telescopic jack.

The tray is advantageously fitted with a hydraulic shock absorber ensuring its braking at the end of its run.

The wedging means, the ramming means and the tray are preferentially brought back simultaneously into the rear inoperative position after the shell has been positioned in the forcing cone of the weapon barrel.

The return rotation of the wedging means out of the tray and the return rotation of the tray out of the cannon axis are carried out simultaneously seeing that the wedging means, ramming means and tray have gone back into the rear inoperative position.

A first advantage of the invention lies in the fact that it is possible for a weapon having a screw breech to be loaded at an equivalent or even higher rate than that of weapons having a breech ring.

Another advantage lies in the fact that the sealing cone of the weapon barrel is protected from any shocks caused by the shell.

Another advantage lies in the improved compactness of the positioning device.

BRIEF DESCRIPTION OF THE DRAWINGS

Other characteristics, details and advantages of the invention will become more apparent after reading the additional descriptions that follow of the different embodiments, such descriptions being made in reference to the drawings, in which.

DETAILED DESCRIPTION OF THE PREFERRED EMBODIMENTS

Figure 1:
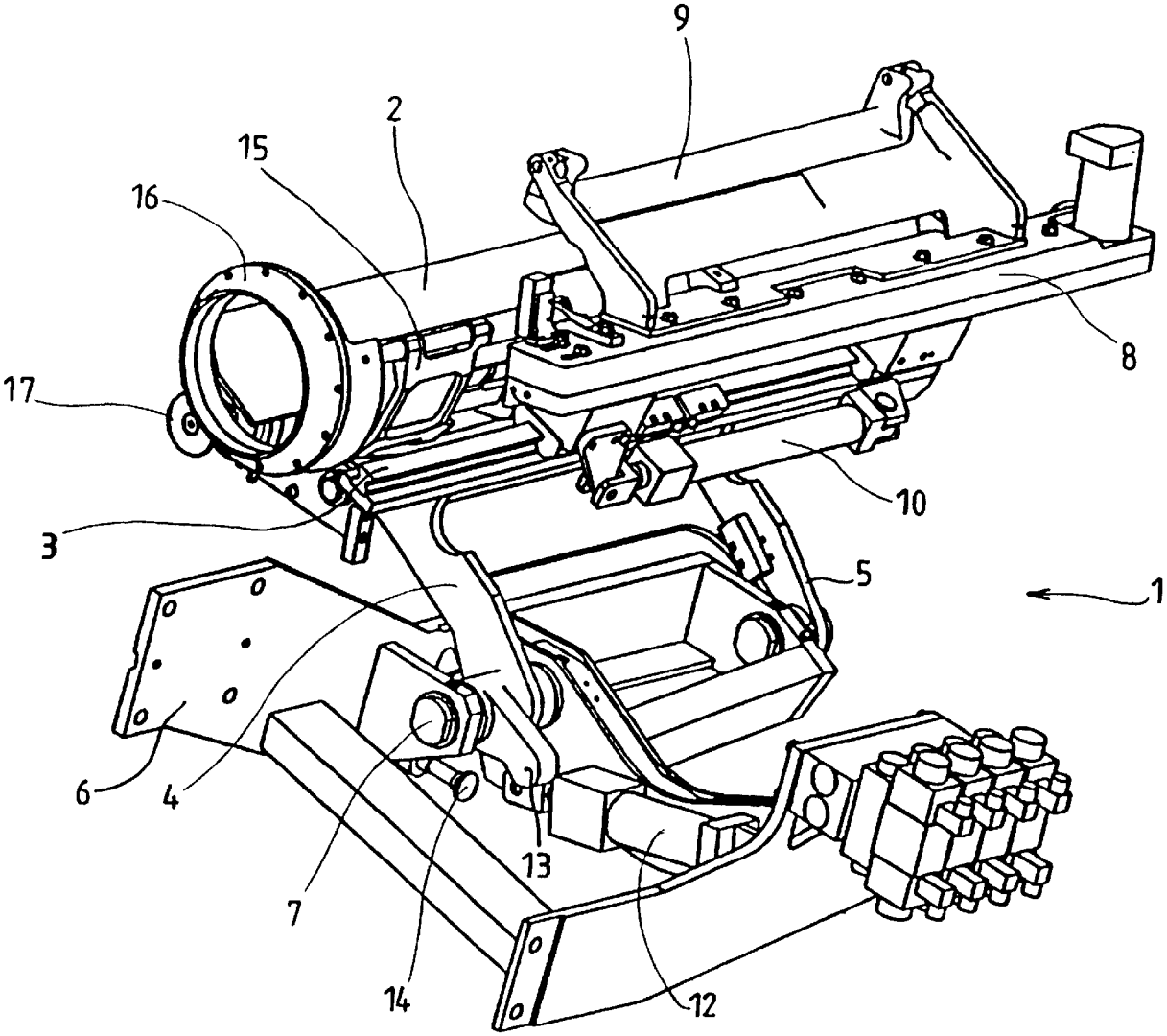
FIG. 1 is a front perspective view of the device according to the invention.

The loading device 1, a front view of which is given in FIG. 1, comprises in a known manner a tray 2, in the form of an elongated trough, able to translate with respect to a slide 3 connected namely to the frame, not shown, of the weapon by means of two arms 4 and 5. Naturally, the dimensions of the tray and namely its length and its curve radius are such that they allow it to support all types of ammunition intended to be fired from these weapons.

More specifically, the slide 3 is rigidly connected to arms 4 and 5, whereas these arms are integral with a structure 6 by means of a hinge pin 7 around which the slide can rotate between a set up position and a loading position. The tray 2 carries a chain rammer 8 supporting blocking means 9 for the shell when it is placed on the tray so as to prevent it from being ejected during the displacement of the tray. The tray is made to be able to translate with respect to the slide 3 by means of a jack 10. The rotation of arms 4 and 5 driving the tray 2 is caused by a jack 12 integral on one side of with the structure 6 and the other with arm 4. The figure shows that arm 4 is fitted with a snug 13 pressing on the rod 14 of a shock absorber to brake and amortize the rotational movement of the slide.

Figure 2:
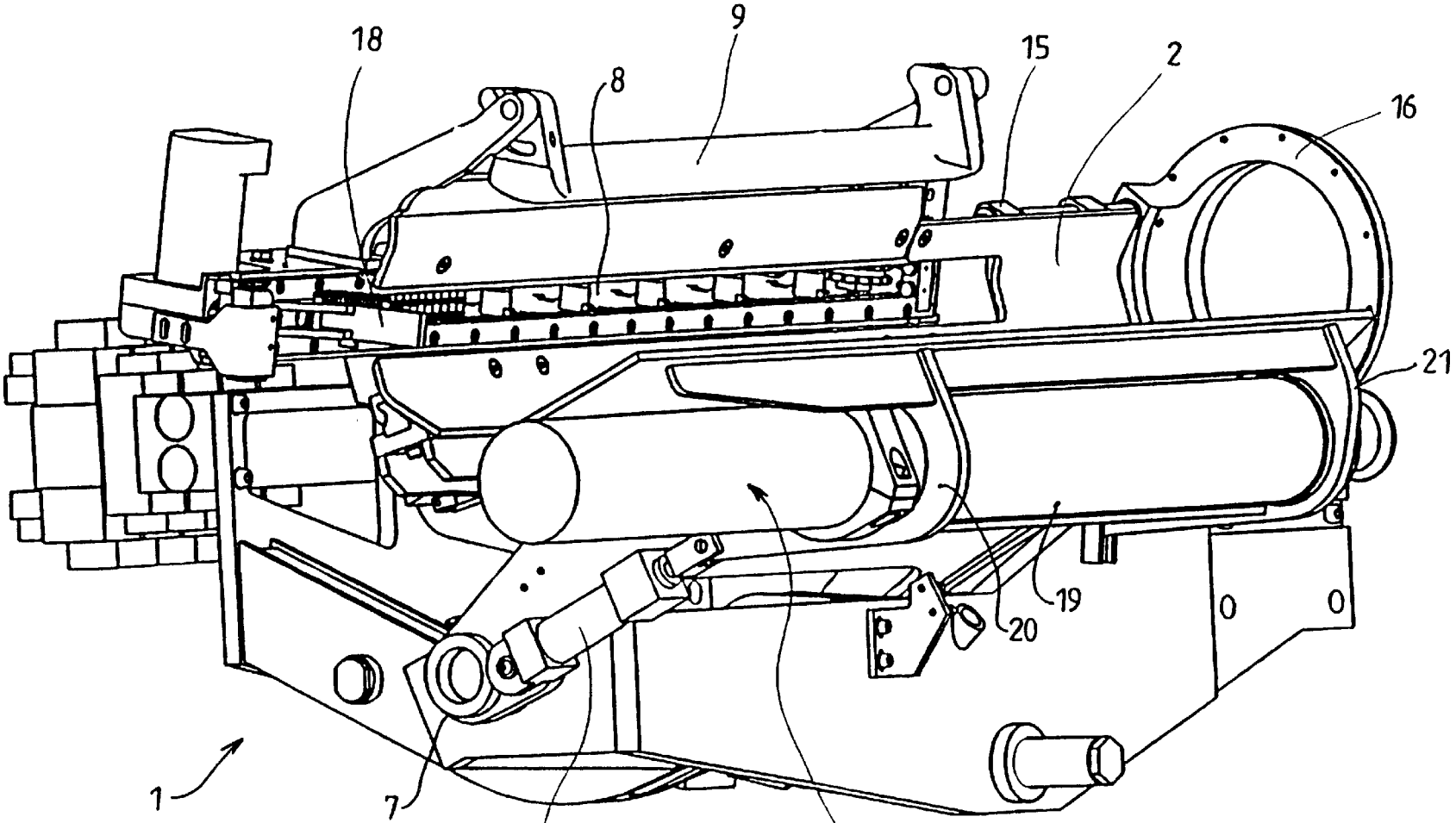
FIG. 2 is a rear perspective view of the device according to the invention.

According to the invention, the tray 2 is extended forwards by a support 15 carrying a ring 16 and FIG. 1 shows the front end of wedging means 17 that are described more fully with reference to FIG. 2. This figure shows a rear view of the right side of the tray 2, the chain rammer 8 having a finger 18 intended to be applied to the rear of the shell in order to move it with respect to the tray as will be explained hereafter. Means 17 are here in the form of a telescopic jack whose body 19 is integral with two wings 20 and 21 that are themselves mounted articulated with respect to arms 4 and 5 of the slide 3. Wings 20 and 21 are made to rotate by means of a jack 22. This jack 22 is integral on one side with the hinge pin 7 of arm 5 and on the other with wing 20. Thus, wedging means 17 can tip into this tray 2 by rotating with respect to said tray in order to lie substantially in the cannon axis.

Figure 3:
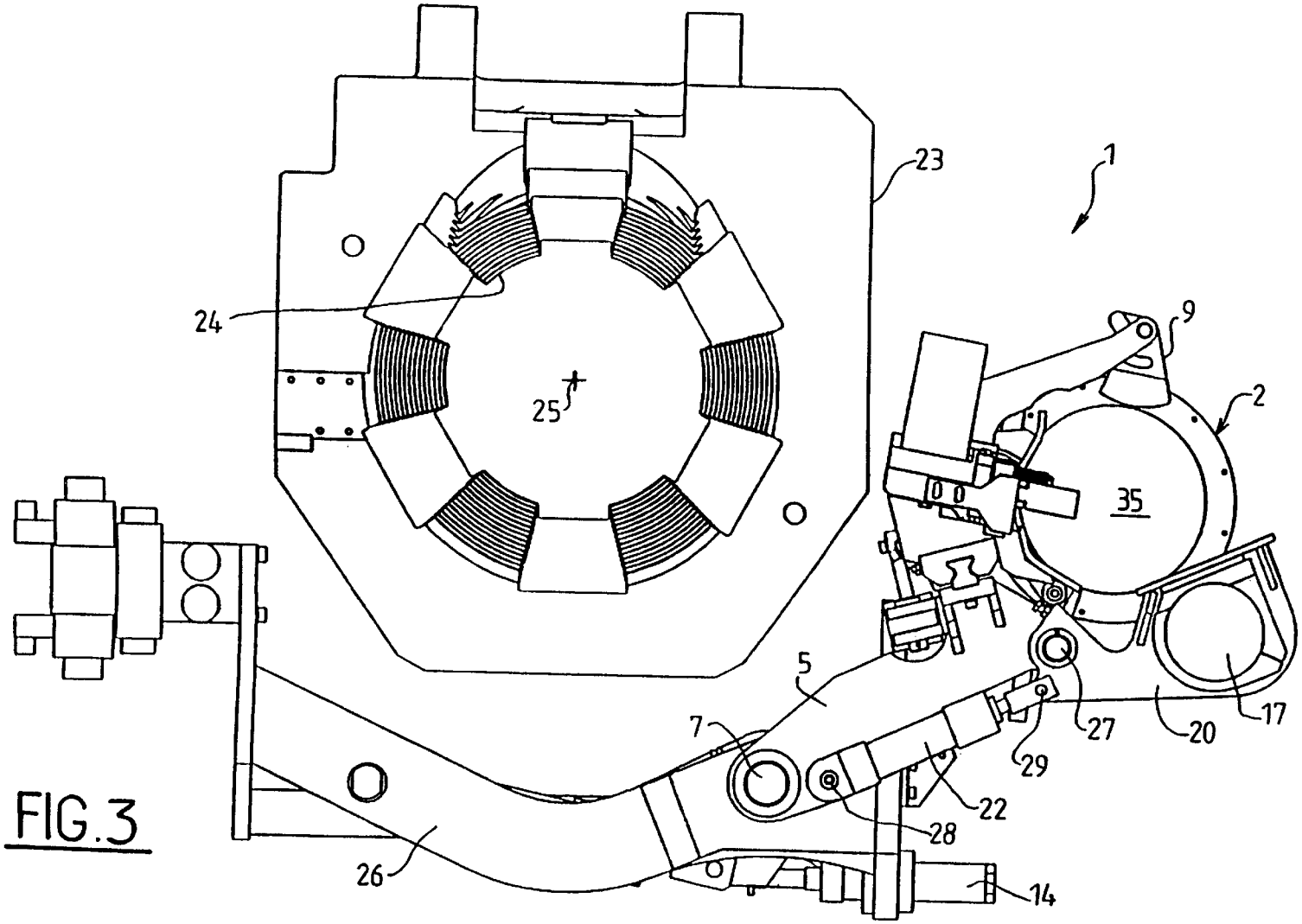
FIG. 3 is a rear view showing the starting position of the device with respect to the weapon.

The rear part of the weapon, on which the breech 23 with the receiving threads 24 of the screw and the axis 25 of the cannon can be seen, is shown in FIG. 3. The screw, not shown, is mounted onto the upper part of the breech. The frame 26 of the weapon that can be seen on this figure supports arms 4 and 5 and the previously described device 1 assembly. Wing 20 can also be seen on this figure articulated around hinge pin 27 integral with the slide 3. The jack 22 is mounted between a shaft 28 fastened to arm 5 and a shaft 29 integral with wing 20.

Figure 4:
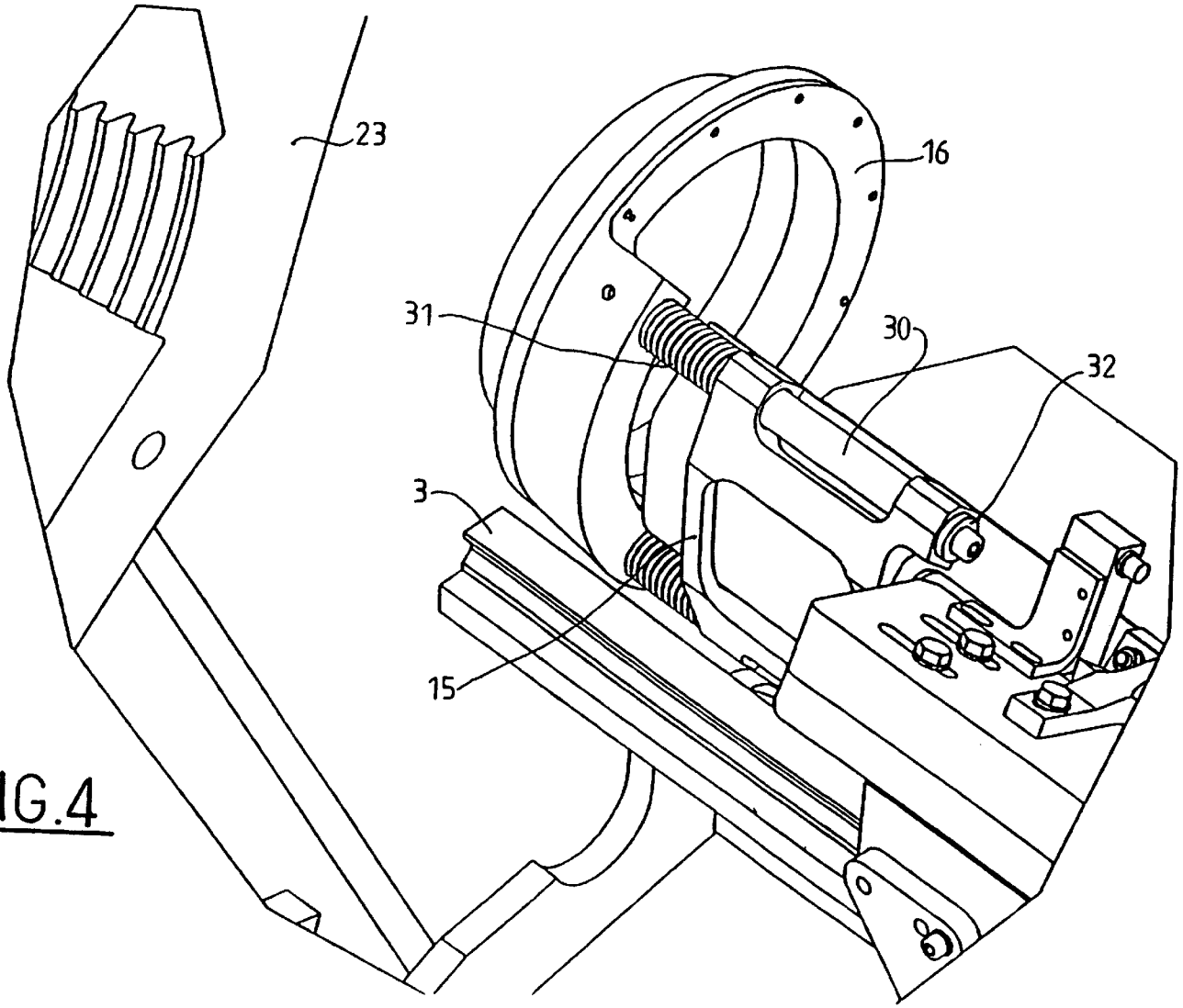
FIG. 4 is a perspective view showing the front part of the tray.

FIG. 4 also shows the structure of the ring 16 and 10 its telescopic mounting on the support 15 extending the tray 2. This ring 16 has a cone-shaped outer profile intended to match that of a sealing cone of the cannon, said cone intended to co-operate with a joint carried by the screw (see FIG. 7). The inner diameter of this ring is substantially greater than the diameter of the shell so as to allow it to pass through freely. The ring 16 is mounted flexibly with respect to the support 15 by means of the rods 30 and the springs 31. To this end, the rods 30 are screwed for example in the ring and slide freely with respect to the support 15. A locking ring 32 allows the translation of the rods to be limited. The ring 16 is made, for example, totally or partially of Teflon (registered trade mark for polytetrafluorethylene) or any other equivalent material. Thus, during successive firings, the Teflon part of the ring 16 comes into contact with the sealing cone of the cannon and prevents any contact between it and the shell. The operation of the weapon is thereby improved and deterioration to the sealing cone is prevented. The original sealing of the 30 weapon is thus preserved. Moreover, the telescopic mounting of the ring 16 allows the differing gaps between the rear part of the cannon barrel and the device 2 according to the invention to be offset at the end of each forward displacement phase of this device. Lastly, the ring 16 amortizes the contacts between the tray and the cannon during the passage of the shell.

The device operates according to the following cycle.

First of all in a first phase a shell 35 is manually placed in the tray 2, in the position shown in FIG. 3. The shell 35 is automatically blocked by the blocking means 9. In this configuration, the finger 18 of the chain rammer is in an inoperative position pressing on the base of the shell.

Figure 5:
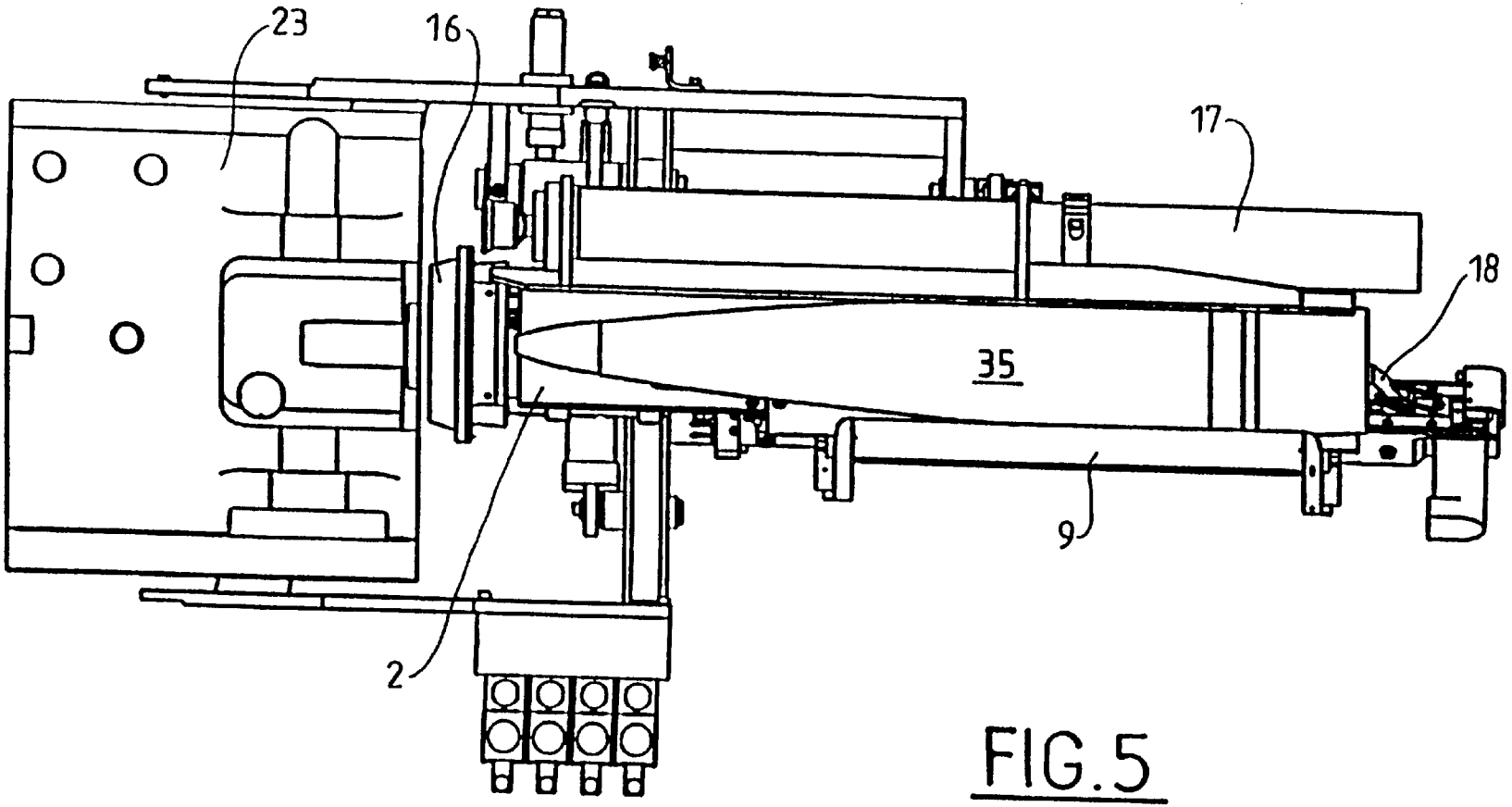
FIG. 5 is a top view showing the positioning of the device with respect to the weapon at the onset of the ramming operation.
Figure 6:
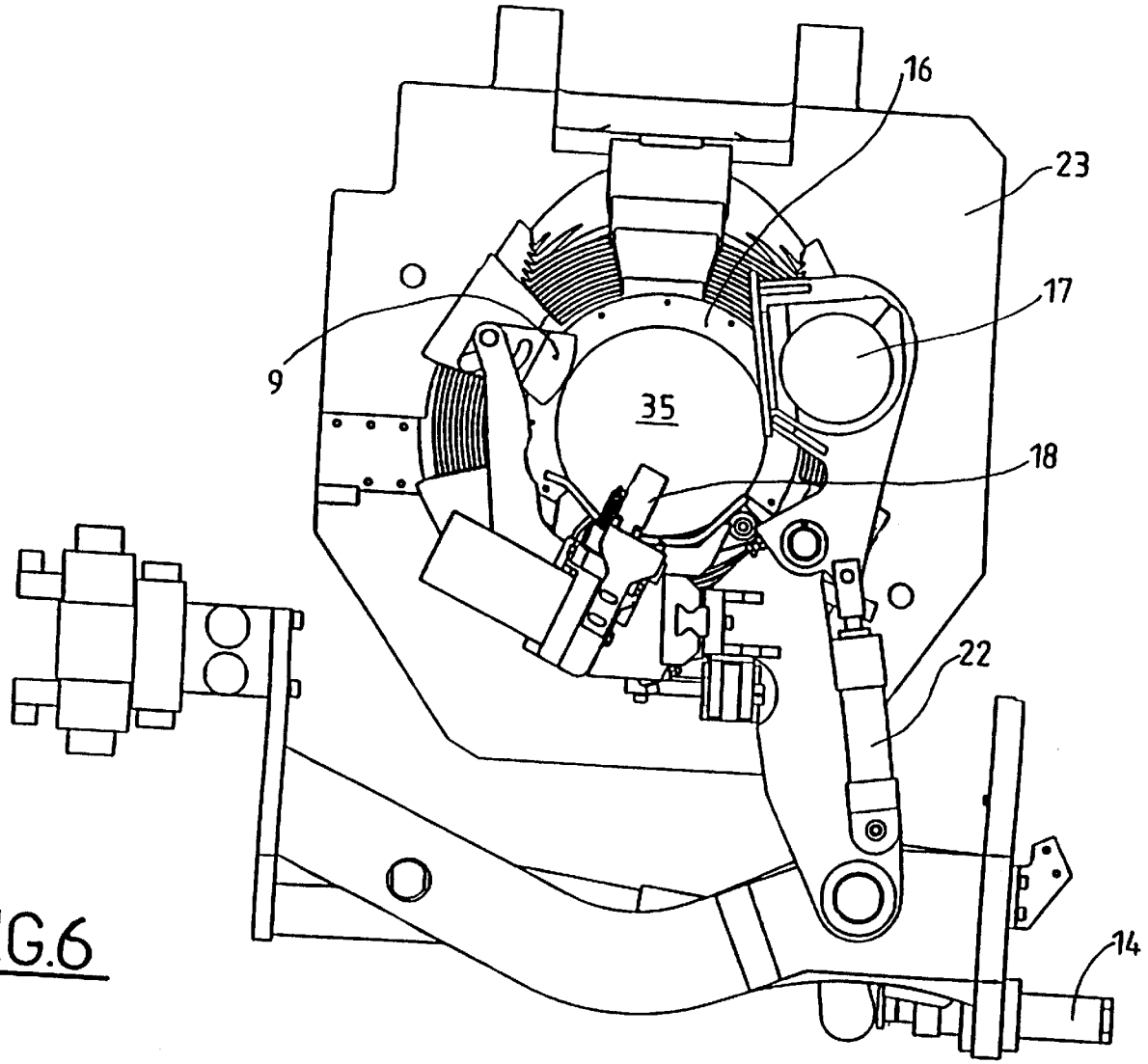
FIGS. 6 to 8 illustrate three phases of the device in operation.

In a second phase, the jack 12 is activated causing the tray 2 to rotate and occupy the position schematized in FIG. 5, which represents a partial top view of the weapon, and in FIG. 6 according to a rear view. The shell 35 is then aligned with the cannon axis and the ring 16 is placed in the axis of the screw breech 23.

To optimize efficiency and to accommodate the operational constraints, the rotation of the tray is hydraulically controlled by control means of a known type and is amortized at the end of its run by means of the hydraulic shock absorber 14.

Figure 7:
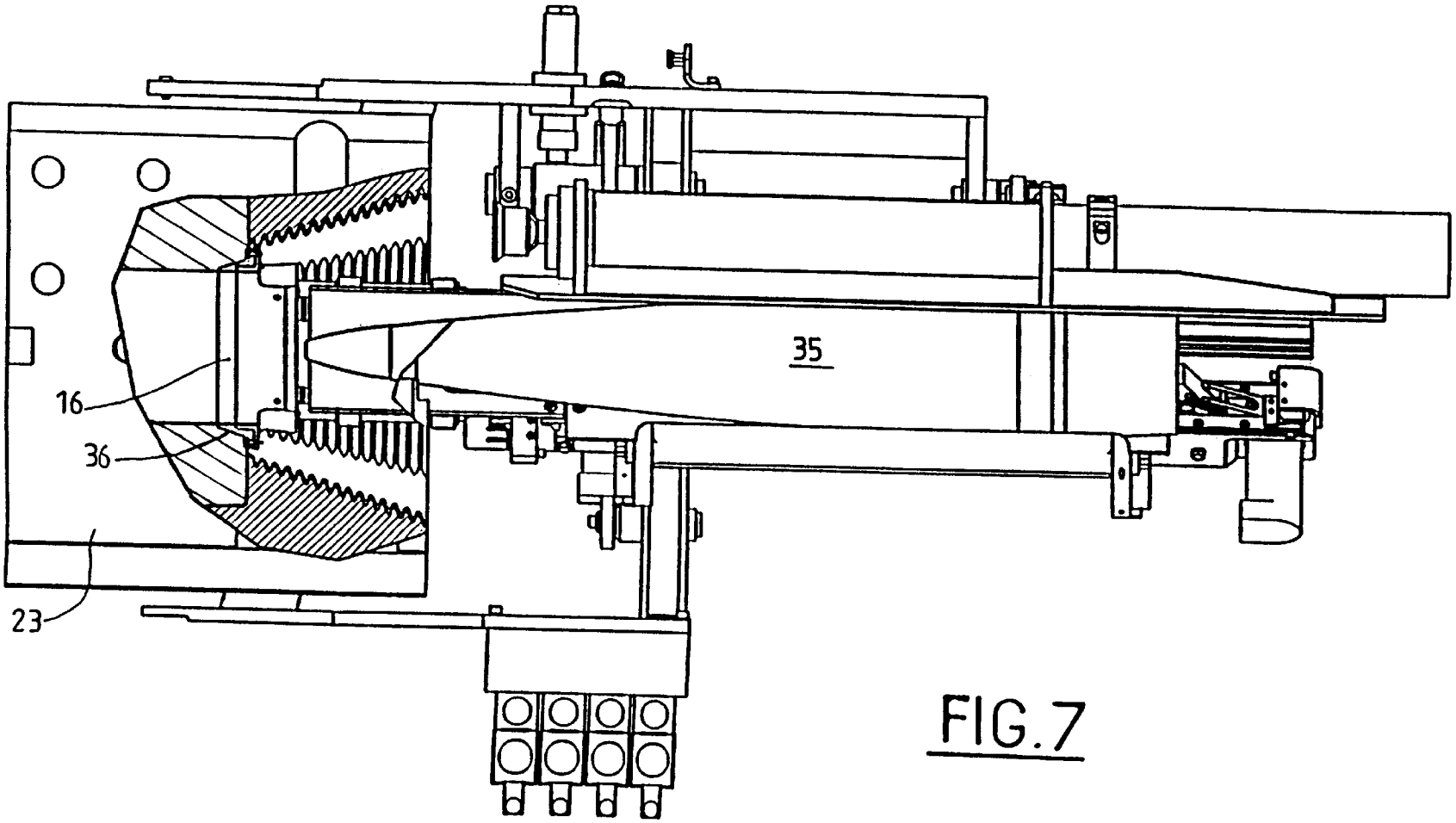

In a third phase, after this first rotation, the linear jack 10 is activated bringing the tray 2 and the shell 35 by axial translation into the breech 23 as can be seen in particular in FIG. 7, which shows a top view partially torn away at the breech. The ring 16 is here pressing on the sealing cone 36 of the cannon barrel.

Figure 8:
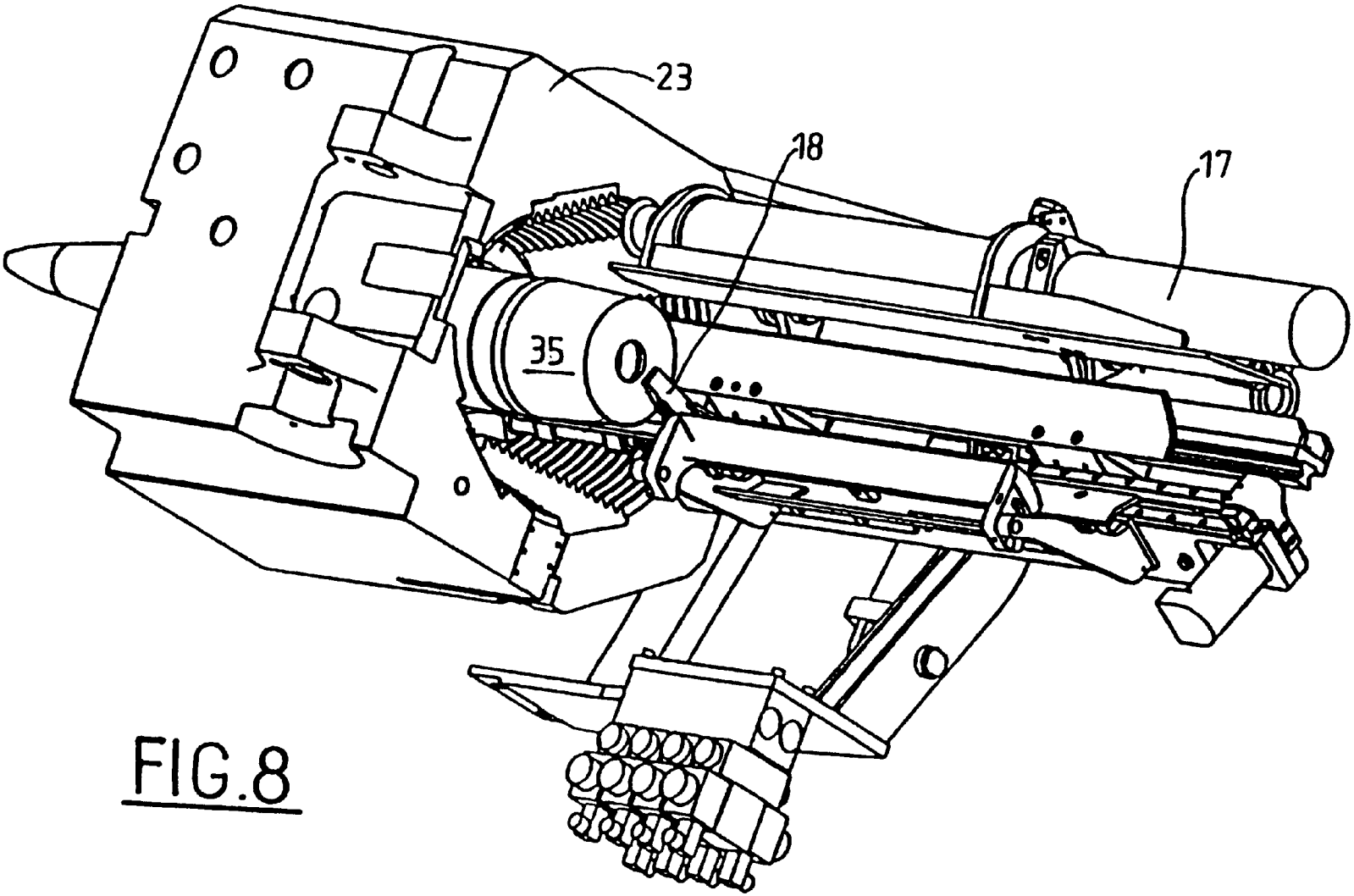

In a fourth phase, the chain rammer is activated whose finger 18 drives the shell 35 that slides with respect to the tray 2 up to the weapon chamber (FIG. 8). At the end of this translation, the shell leaves the tray altogether and is fully engaged in the screw breech. In this position, the tray 2 is immobilized by the breech and can not be rotated.

Figure 9:
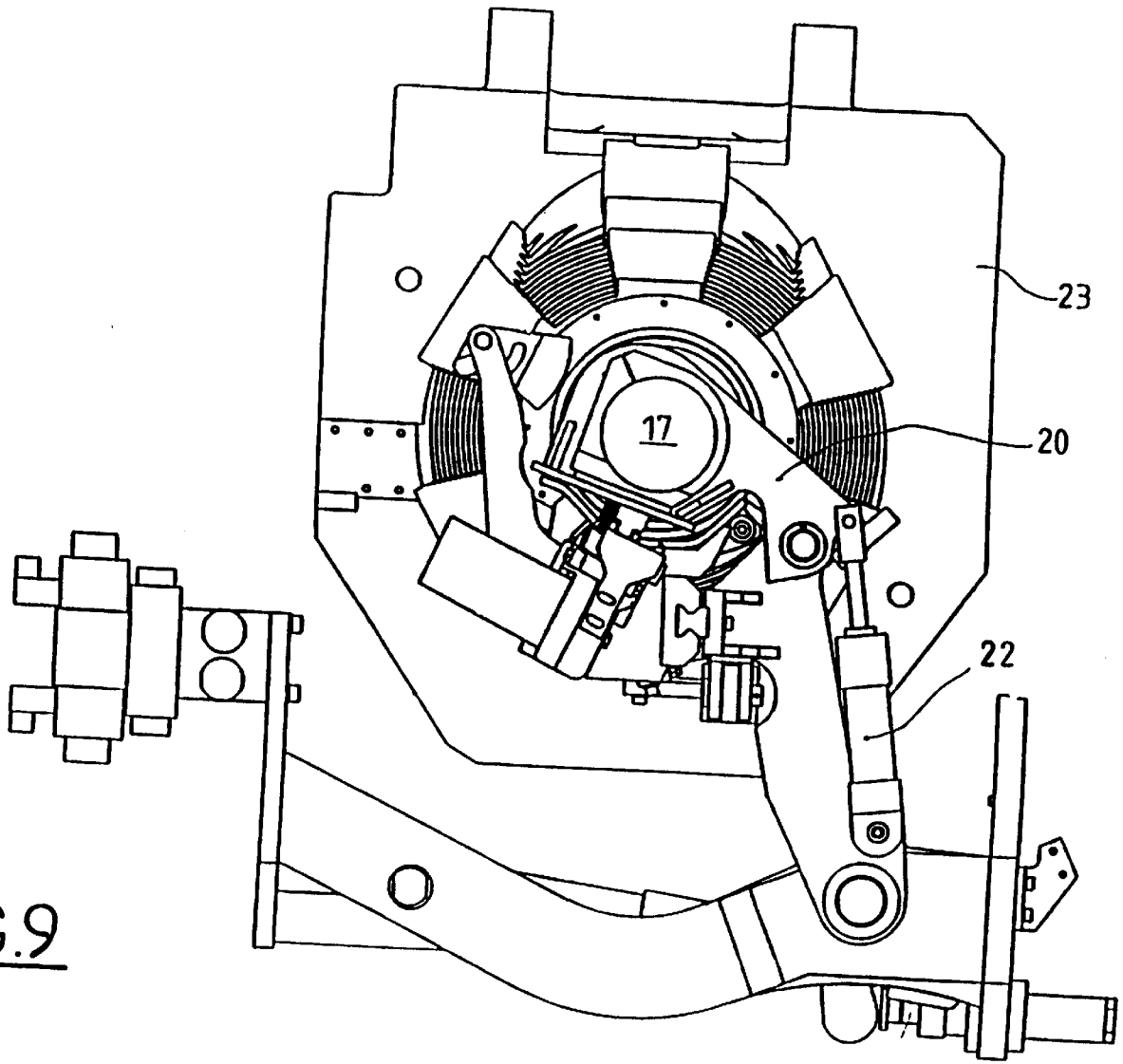
FIG. 9 is a rear view showing the positioning of the wedging means.
Figure 10:
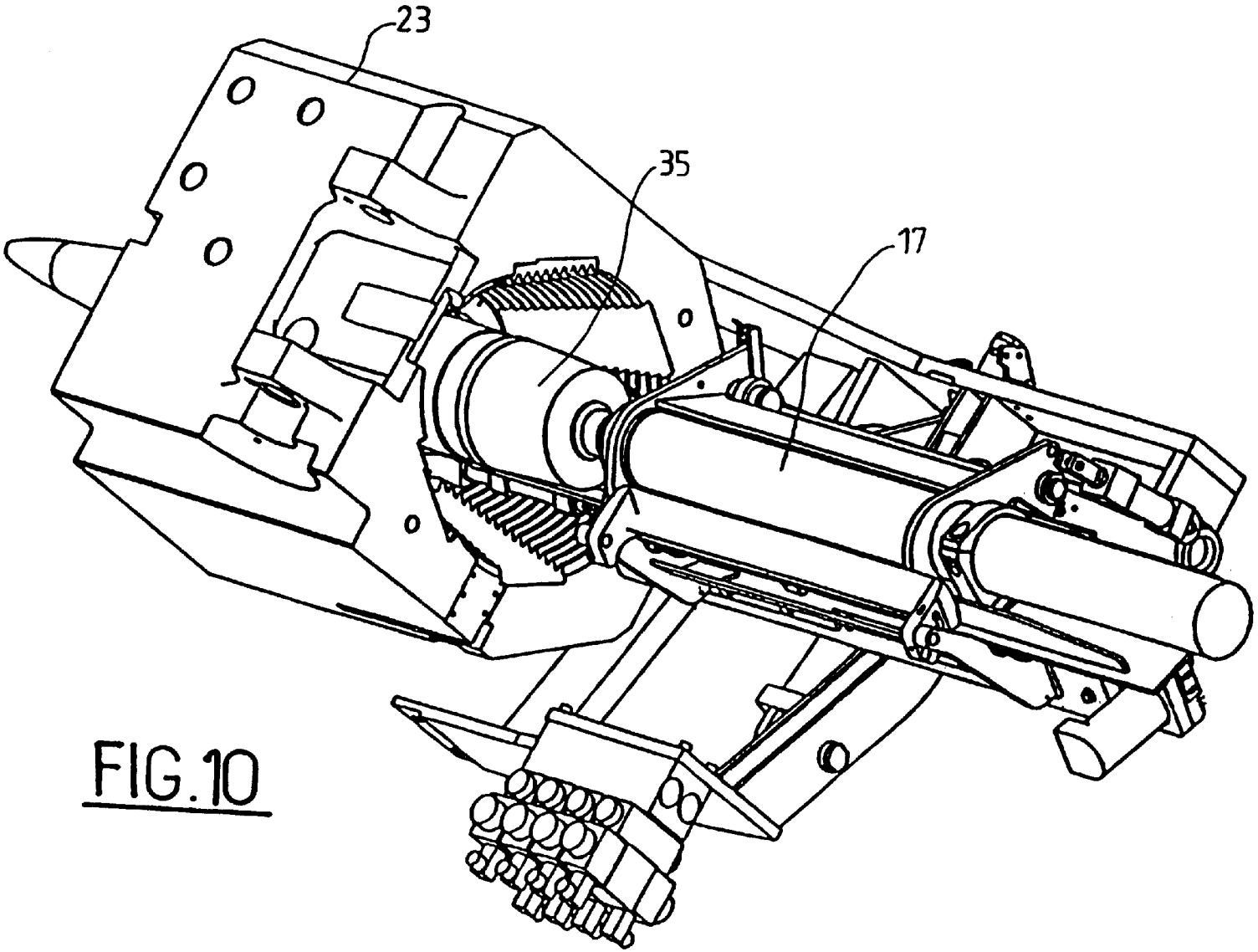
FIGS. 10 and 11 illustrate two phases of the wedging device in operation.

This is why, in a fifth phase, the jack 22 is activated rotating the wedging means 17 into the tray 2, substantially in the cannon axis, as can be seen in FIGS. 9 and 10.

Figure 11:
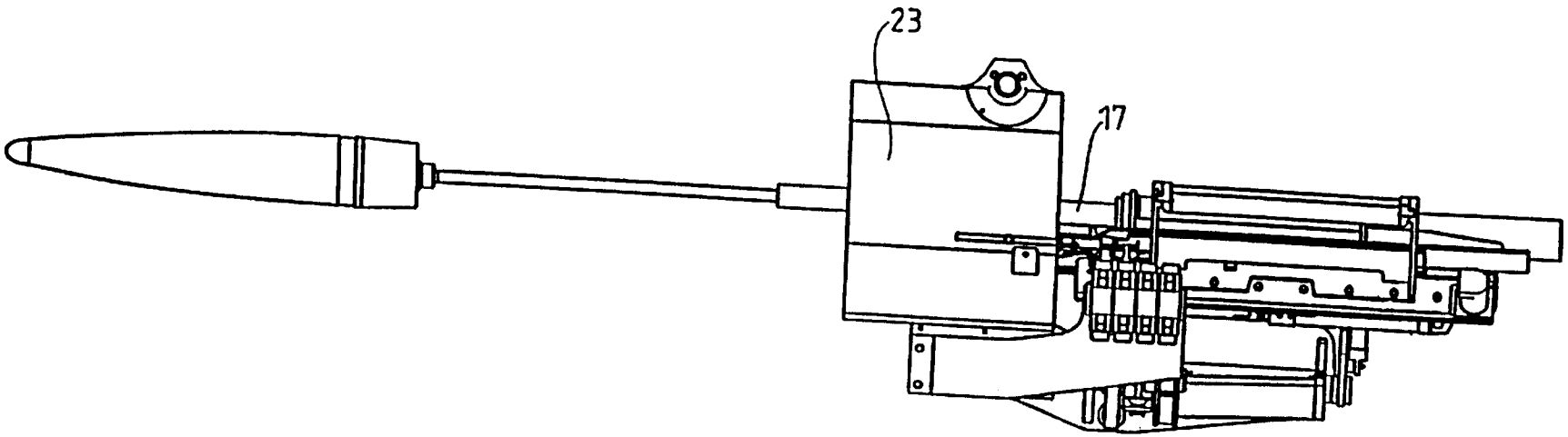

In a sixth phase illustrated by the top view in FIG. 11, the wedging means 17 are activated and drive the shell 35 from the breech 23 into the cannon barrel of the weapon and into contact with the forcing cone (not shown). Means 17 are, in this case, in the form of a telescopic jack whose stroke is calculated to ensure the necessary trajectory for the shell.

The loading sequence for the shell 35 is complete and the return of the loading device 1 is effected so as to bring it back to the set up position shown in FIG. 3.

For this, and as a first step, the telescopic jack 17, the chain rammer 8 and the tray 2 are simultaneously brought back to the rear inoperative position. The telescopic jack is retracted, the chain rammer is brought into its starting position and the linear jack 10 brings the tray into the rear position in which it is disengaged from the breech.

As a second step, when the afore-mentioned return movements have been completed, the jacks 22 and 12 are activated simultaneously. The jack 22 allows the return rotation of the wedging means 17 out of the tray 2 and allows the return rotation of the tray 2 out of the cannon axis.

The shell being inserted and the loading device disengaged, the propellant charge can [not] now be manually placed into the weapon chamber. The screw breech is closed and firing can commence.

The simultaneity of the return movements allows the loading device to be rapidly disengaged from the cannon axis. This ensures a high rate of fire.

Naturally, all the phases are linked to a control logic and sensors are provided to pick up the starting and finishing positions of each element. Thus, for example, the rotation of the wedging means 17 out of the tray by activation by the jack 22 and the rotation of the tray 2 out of the cannon axis by activation of the jack 12 can only take place if the end-of-operation sensors for the retraction of the telescopic jack 17, the rammer 8 and the linear jack 10 have all been activated.

The invention is naturally not limited to the single embodiment described here but also covers variant embodiments.

We claim:

1. A loading device for loading a shell in combination with a weapon fitted with a screw breach, comprising:

a weapon having a weapon chamber, a receiving tray having a front end fitted with a protection means, said tray for bringing a shell from an initial set up position to a loading position in which said shell is aligned with the longitudinal axis of weapon chamber;

ramming means;

wedging means to wedge said shell in said weapon chamber, wherein said ramming means and said wedging means are arranged to operate successively; and a slide configured for connection to a frame of the weapon;

said ramming means and said wedging means being attached to said tray, said tray having an articulated connection with the slide for moving a shell from the initial set up position to the loading position, said wedging means having an articulated connection with said tray for moving into said tray in substantial alignment with the weapon axis after a shell has been rammed into the weapon chair, and said tray protection means configured to abut a sealing cone of said weapon when said tray is engaged in the weapon breach.

2. A loading device according to claim 1, wherein said protection means includes, with respect to said tray, tolerances for avoiding any possible differences in gaps between said breech and said tray.

3. A loading device according to claim 2, wherein said protection means is integral with rods slidingly mounted with respect to said tray, said loading device further comprising springs positioned between said tray and said protection means.

4. A loading device according to claim 3, wherein said springs are placed around said rods.

5. A loading device according to claim 4, wherein said protection means comprises a ring of plastic material having an inner diameter substantially greater than the outer diameter of said shell and an outer profile shaped to match a profile of said sealing cone.

6. A loading device according to claim 5, further comprising at least one jack and two wing members, wherein said wedging means is connected to said tray by said wing members articulated with respect to said tray, said at least one jack being placed between said tray and a pivotable attachment to said frame for bringing said wedging means into a wedging position.

7. A loading device according to claim 6, wherein said wedging means comprises a telescopic jack.

8. A loading device according to claim 7, wherein said tray is fitted with a hydraulic shock absorber ensuring its braking at the end of its run for stopping the tray.

9. A loading device according to claim 8, wherein said wedging means, said ramming means and said tray are brought back simultaneously into an inoperative position distal the weapon breach after a shell has been positioned in said weapon chamber.

10. A loading device according to claim 9, wherein return rotation of said wedging means out of said tray and return rotation of said tray out of said cannon axis occur simultaneously after said wedging means, said ramming means and said tray have returned to the inoperative position.

11. A loading device according to claim 1, wherein said protection means comprises a ring of plastic material whose inner diameter is substantially greater than the outer diameter of said shell and whose outer profile is shaped to match the profile of said sealing cone.

12. A loading device according to claim 11, further comprising at least one jack and two wing members, wherein said wedging means is connected to said tray by said wing members articulated with respect to said tray, said at least one jack being located between the tray and a pivotable attachment to the frame for bringing said wedging means into a wedging position.

13. A loading device according to claim 12, wherein said wedging means comprises a telescopic jack.

14. A loading device according to claim 13, wherein said wedging means, said ramming means and said tray return simultaneously to an inoperative position distal the weapon breach after said shell has been positioned in said weapon chamber.

* * * * *